United States Patent [19]

Berg

[11] Patent Number: 4,461,232

[45] Date of Patent: Jul. 24, 1984

[54] LIGHTWEIGHT MARINE BARGE COVER

[75] Inventor: Robin L. Berg, Hudson, Wis.

[73] Assignee: Proform, Inc., Minneapolis, Minn.

[21] Appl. No.: 282,318

[22] Filed: Jul. 10, 1981

[51] Int. Cl.[3] ..... B63B 19/14

[52] U.S. Cl. ..... 114/201 R; 52/309.16; 52/630; 52/828

[58] Field of Search ..... 114/201 R, 203; 220/71, 220/72; 52/200, 309.16, 630, 828

[56] References Cited

U.S. PATENT DOCUMENTS

| | | | |
|---|---|---|---|
| 2,061,337 | 11/1936 | Taylor | 114/201 R |
| 3,302,361 | 2/1967 | Oudheusden, Jr. et al. | 52/828 X |
| 3,800,723 | 4/1974 | Collins | 114/201 R |
| 3,886,705 | 6/1975 | Cornland | 52/630 |

FOREIGN PATENT DOCUMENTS

| | | | |
|---|---|---|---|
| 969460 | 6/1975 | Canada | 52/309.16 |

*Primary Examiner*—Sherman D. Basinger
*Attorney, Agent, or Firm*—Oblon, Fisher, Spivak, McClelland & Maier

[57] ABSTRACT

An oceangoing barge cover is provided, which is made from lightweight structural fabric but enjoys the strength and stiffness of heavier steel covers and meets the requirements of the American Bureau of Shipping. The cover is comprised of a series of units, each of which in crosssection, is in the form of a series of concave quaternary curves, to the underside of which are fixed structural beams of fiberglass encasing rebar for support. Further support is provided by pipes of a structural fabric running perpendicular to the structural beams. A hatch can be optionally provided. Weather-sealing and barge affixing means are also disclosed. In a preferred embodiment, the structural elements of the cover are comprised of fiberglass or fiberglass laminate.

21 Claims, 10 Drawing Figures

LIGHTWEIGHT MARINE BARGE COVER

BACKGROUND OF THE INVENTION

This invention relates to hatch covers for oceangoing barges. As the cost of transportation has become an increasingly large part of the cost of material goods, transportation of materials in the holds of oceangoing barges has become increasing popular. This invention relates to an improved cover for the hatches or holds of such oceangoing barges.

PRIOR ART

Hatch covers have long been used on ships of various kinds. The present invention relates primarily to the hatch covers specially adapted to cover the hatches of oceangoing barges. Barge covers may be further distinguished in that some are roll-top covers, while others are lift-off covers. The present invention relates to a lift-off barge cover for an oceangoing vessel.

Various governmental agencies regulate the merchant marine fleet, including oceangoing barges. An oceangoing barge must not only meet the desired performance specifications of its owner, it must also meet the seaworthiness requirements of the various regulatory bodies. In particular, hatch cover regulatory requirements specify characteristics, such as, the strength of the cover, the deflection of any particular span across the cover, the thickness of the cover, and the mechanism for securing watertightness between the cover and the hatchway.

Among the most important of regulatory agencies and regulations is the American Bureau of Shipping and the Rules for Building and Classing Steel Vessels, as well as the American Bureau of Shipping's other regulations, including Rules for Building and Classing Plastic Vessels. The reguirements included in these Regulations have become increasingly stringent in the recent past, and are keyed to the strength characteristics of steel. Accordingly, the barge covers of the present invention must, in effect, meet the strength and stiffness requirements of steel. The present invention is a particular advance over the state of the art in that, rather than the comparatively heavy material of steel or traditional steel substitutes, a lightweight structural fabric is employed in the construction of the barge cover, thereby dramatically reducing the overall weight of the barge cover and the barge itself.

It will be recognized that, as the cost of fuel increases, the importance of weight reductions in transportation vehicles becomes correspondingly more important. Additionally, as the amount of tonnage a particular barge can carry is determined, in part, by displacement and draft, the lighter weight structural fabric results in less initial displacement, therefore allowing a greater load to be carried, and reducing the cost per pound of materials transported. Thus, the hatch cover for oceangoing barges disclosed and claimed herein is a significant advance over the current state of the art.

SUMMARY OF THE INVENTION

As indicated, one object of this invention is to provide an oceangoing barge cover which is substantially lighter in weight than the steel and metal covers of the prior art.

Another object of this invention is the provision of a cover constructed of structural fabric which meets the minimum requirements of the American Bureau of Shipping and other regulatory agencies, and has strength characteristics that resemble those of steel barge covers of the prior art, as is shown in U.S. Pat. No. 3,785,322.

Yet a further object is to provide a lightweight oceangoing barge hatch cover which has a relatively simple construction but easily can be made watertight.

The inventor has suprisingly discovered that, by providing a structural fabric cover, preferably of fiberglass, that is, in cross-section of a shape corresponding to a repeating series of concave caternary curves, there is a significant increase in strength in the cover. The strength of the cover is further increased by providing support beams on the underside of the cover, also preferably made of fiberglass or similar structural fabrics, which, by the use of reinforcing bars (rebar), are made relatively short and lightweight, yet strong. Further reinforcement is provided by the use of fiberglass pipes running perpendicular to, and through, the structural support beams.

In an effort to provide still further strength and stiffness, a reinforced layer of structural fabric, preferably some form of fiberglass, is provided, at the point of attachment of the support beams to the cover member itself; this selective reinforcement increases strength and stiffness surprisingly, while keeping weight increase at a minimum.

In a further preferred embodiment, in order to provide further strength, where a fiberglass fabric is employed in the practice of this invention, the fabric may be included in a laminate structure comprised of repeating alternating layers of woven fiberglass, uniglass or other structural material, and fiberglass chopped filler. This particular laminate, although lightweight, provides surprising strength.

One feature that all oceangoing barge covers must be able to exhibit is one or more means for keeping the hold itself watertight, and preventing weather or ocean elements from entering and fouling the cargo. Although preferred means are disclosed herein, alternative means are also known in the art.

It will, therefore, be recognized that the cover disclosed and claimed herein achieves the objects discussed above, and has the further advantage that it is much less expensive and much lighter in weight than prior art steel covers. Furthermore, maintenance and repair are more easily accomplished and thus less expensive. Rust, barnacles and other problems encountered with metal parts are not a problem with parts made from the structural fabric of this invention.

Furthermore, the present invention is easily handled; at ports having cranes with weight restrictions, barge covers of the present construction are easily lifted, while prior art steel covers must sometimes include means for separating the cover units into multiple, discrete parts to permit handling by low capacity cranes.

The advantages and other objects obtained by the use of oceangoing barge cover of this invention may be better understood by reference to the drawings which form a further part hereof, and to the accompanying descriptive matter in which there is illustrated and described a preferred embodiment of the invention.

DESCRIPTION OF THE DRAWINGS

The invention of applicant can be more fully understood by reference to the drawings herewith.

DETAILED DESCRIPTION OF THE INVENTION

With reference to the drawings, applicant's invention will be described in detail.

Figure 1:
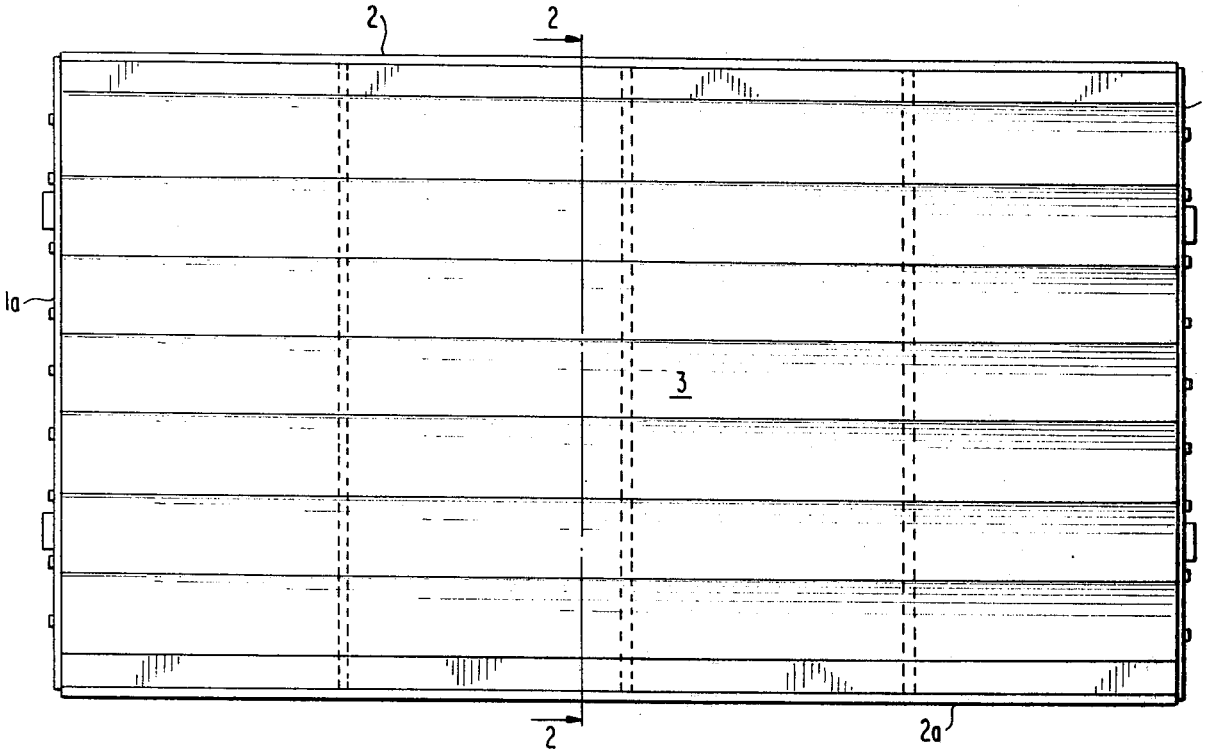
FIG. 1 is a surface or plan view of a single section of the barge cover of this invention.
Figure 5:
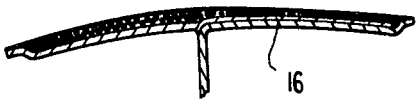
FIG. 5 is an enlarged view of the reinforced section labelled 5 in FIG. 2, which is the point of attachment of the structural beam of FIG. 3 to the actual covering member of the barge cover of this invention.
Figure 2:
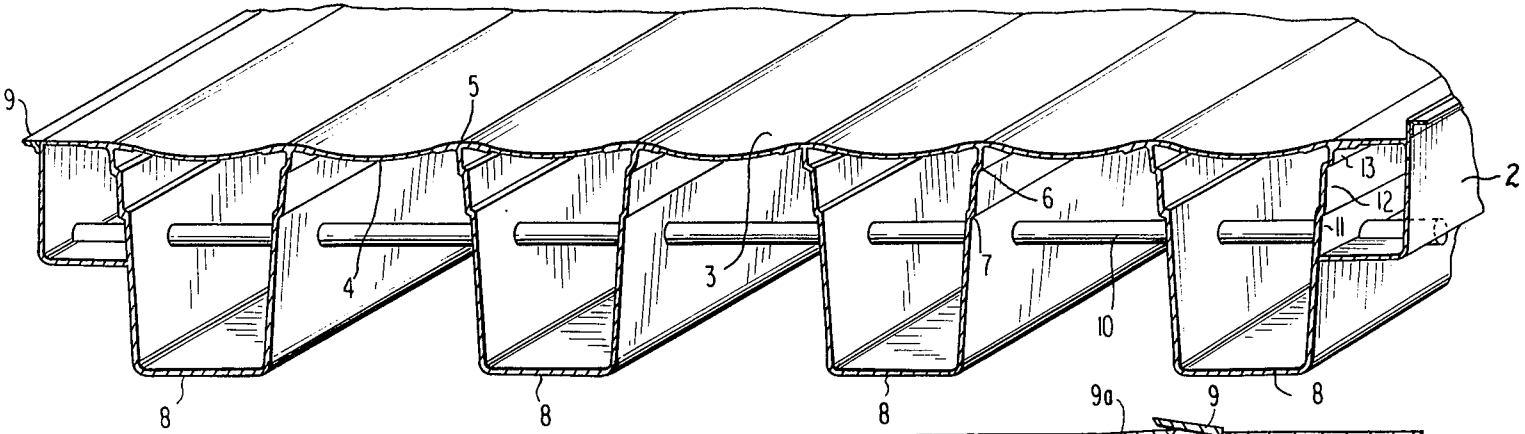
FIG. 2 is a view of cross-section "2—2", take along the cross-section of the barge cover.
Figure 9:
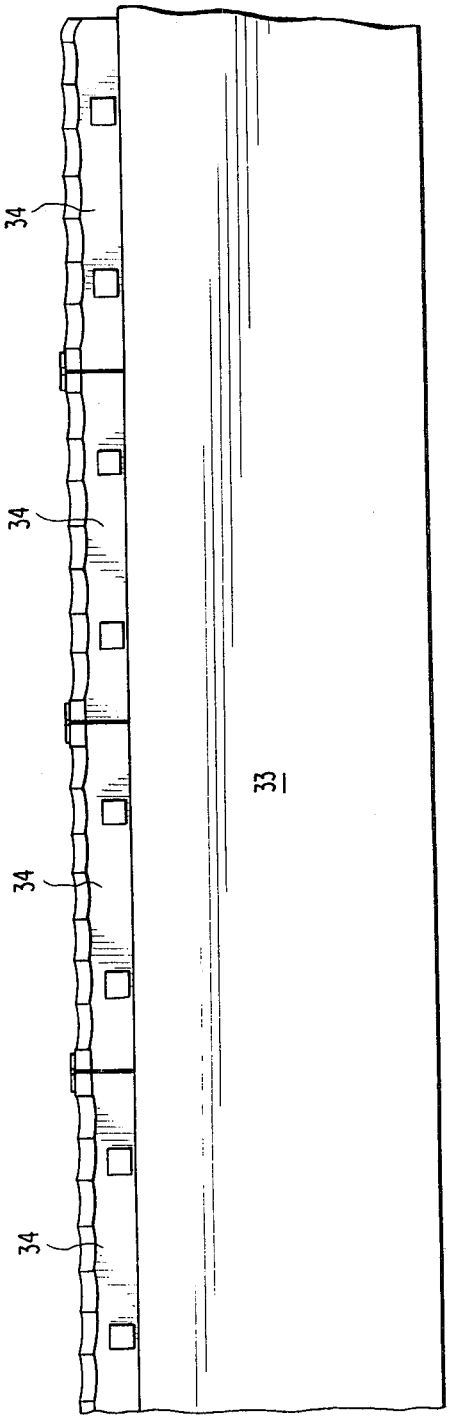
FIG. 9 is the side view of a portion of the barge with its barge cover in place, composed of several sections.

As is shown in the side view of FIG. 9, the barge cover of this invention is composed of a series of several sections, each section being substantially similar to the others. One such section is pictured in plan view in FIG. 1. Each section is comprised of lateral end panels 1, 1*a* and longitudinal end panels 2, 2*a* both made in similar fashion. Both lateral and longitudinal end panels extend integrally downward from cover member 3. As can be seen in FIG. 2, cover member 3 is, in cross section, a series of concave caternary curves 4, each joined to the next at the peak 5 of each curve, which peak is reinforced, as can be seen in FIG. 5. It should be understood that the entire cover member 3, including sides 1, 1*a* and 2, 2*a* is a single structural piece, and reference is made to repeated curves and joining merely for sake of descriptive clarity.

Cover member 3 is supported by a plurality of support beams 8 affixed to the underside thereof, extending perpendicularly to the longitudinal centerline of the barge. Each support beam resembles in configuration a U, with the walls or legs of the U extending upwardly and slightly outward. Near the top of each leg, there is a first, substantially horizontal, flange 7, in which is encased rebar which lends support and stiffness to the supporting beam. Although, as will be recognized by one of skill in the art, the nature of the rebar will be determined by the structural needs of the barge cover to be constructed, in a preferred embodiment, the rebar employed is No. 8 rebar of grade 60. The leg or wall of the support beam continues substantially vertically beyond horizontal flange 7, until a second substantially horizontal flange 6 is encountered, which second flange also encases rebar 15, grade and quality similar to that encased by flange 7. Beyond substantially horizontal flange 6, the leg or wall of the support beam continues vertically upward until it joins cover member 3.

At the junction of the leg or wall of each support beam 8 with cover member 3, there is a reinforced section formed integrally with cover member 3. This section is illustrated in FIG. 5. Although this reinforced section can be made of any suitable structural fabric, in a preferred embodiment, it is composed of a coated layer of uni-glass, an industrial glass fabric wherein the glass strands comprising the fabric are of uniform orientation. It is again re-emphasized that, although for clarity of description, the configuration and structure of cover member 3 and support beams 8 have been described in discrete sections, each cover member, and each support beam, is an integral solitary structure.

Figure 3:
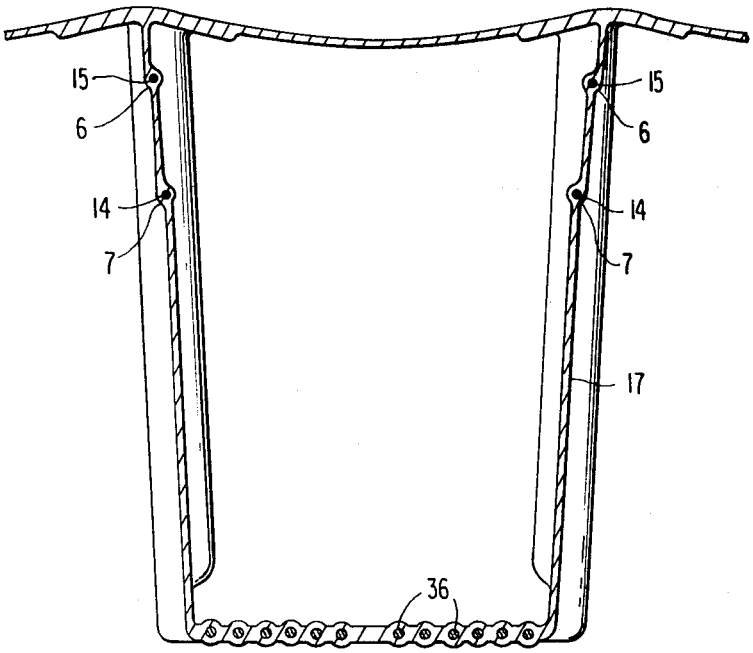
FIG. 3 is a side view of one supporting beam and attendant cover of one section of the barge cover of this invention.
Figure 4:
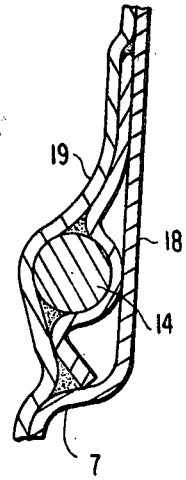
FIG. 4 is an enlarged view of the rebar emplacement in the beam of FIG. 3, labelled 14 in FIG. 3.

As can be seen most clearly in FIG. 3, each support beam 8 encases two reinforcement rebars 14 and 15 in each leg or wall. This method of encasement is most clearly shown in FIG. 4, which illustrates that rebar 14 is completely enclosed within horizontal flange 7 and the vertical wall 17 of support beam 8. It will therefore be recognized that, wherever rebar is to be enclosed, the wall or base of support beam 8 will in fact be a multilayered wall or base of at least two layers, an outer layer 18 and an inner layer 19. Additionally, the base of each support beam 8 encases at least nine, and preferably twelve, rebar reinforcements 36, of similar grade and quality as those employed in the leg or wall of each support beam.

As further support for cover member 3 and the structural beams 8 attached thereto, running throughout support beams 8, and parallel to the longitudinal centerline of the barge to which the cover is attached, are a plurality of reinforcement pipes 10. These pipes can be constructed out of a suitable lightweight structural fabric, although in a preferred embodiment they are constructed of fiberglass reinforced plastic.

Each intermediate cover section of the barge cover of this invention has a weather seal element or flange 9 affixed at either longitudinal end panel. As will be recognized, those sections that lie at either end of the barge will have means on the leading or trailing longitudinal end panel with which to engage the barge in place of a weather seal element. The interaction of corresponding weather seal means of each cover section is most clearly illustrated in FIG. 7, where a preferred embodiment is depicted. In this embodiment, two weather seal flanges 9 and 9*a* overlap. Affixed to longitudinal end panel 2*a* is a further weather seal flange 20, which abuts against a gasket 22 preferably made of EPDM rubber (a terpolymer of polypropylene, ethylene and butadiene). Directly below horizontal flange 20 is a second horizontal flange 21 extending from long wall 2, and abutting against corresponding gasket 23, also preferably constructed of EPDM rubber. It will be recognized that, the combination of weather seal unit 9, along with the two interior flange and gasket devices described above provides not only a fluid-tight seal, but provides channels for the run-off of any water or other fluid that does penetrate beyond weather seal elements 9 and 9*a*. A number of varieties of weather seal arrangements will occur to those skilled in the art. The arrangement illustrated in FIG. 7 and disclosed above is not intended to limit the barge cover of this invention, but rather merely to illustrate one alternative "gasket and seal" arrangement.

Spaced along lateral end panel 1 and 1*a* of cover member 3 and longtiudinal end panels 2 and 2*a* of the leading and trailing cover sections of the barge are provided mechanisms for releasably engaging the barge on which the covers rest, thereby providing a means for preventing movement and slippage of the cover sections and sealing the barge hatches from water penetration. Although any releasable mechanism providing a suitable seal may be used, a preferred embodiment includes a U-shaped bracket 25, affixed to the barge by grommets 26, nuts 27*a* and bolts 28*a*. This bracket may be engaged by arm 27 which is mounted on cam member 28 which can be rotated about a pin. The pin and cam arrangement is secured to the outer wall of a cover section by being mounted on a plate 24 secured to the outer wall by nut and bolt arrangements 29. Thus, when cam 28 and arm 27 are rotated downward, U-shaped bracket 25 is no longer engaged, and the cover section may be moved or lifted away. However, when arm 27 is rotated upward into a "closed" position, arm 27 engages bracket 25, preferably within a notch in bracket 25 (not illustrated) which thereby prevents movement of the cover section. To provide a watertight seal, a wear plate and gasket may be positioned between the barge and the cover section (not pictured). It will be recognized that enough of the illustrated and described securing means, or any other securing means found usable, will be provided about the cover sections to secure said cover sections against movement and water leakage.

Figure 10:
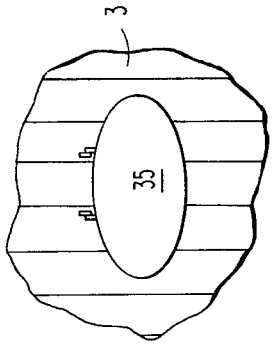
FIG. 10 is a surface view of a hatch which is an optional feature of this invention.

Each unit of the barge cover of this invention may be provided with one or more hatches through which cargo may be directly loaded, avoiding the necessity of lifting the cover unit. As is shown in FIG. 10, the cover consists simply of a hinged door 35 set into cover member 3, arranged so as to provide a watertight seal when in the closed position. Other hatches, such as those disclosed in U.S. Pat. No. 3,730,128, will occur to those of skill in the art.

Figure 7:
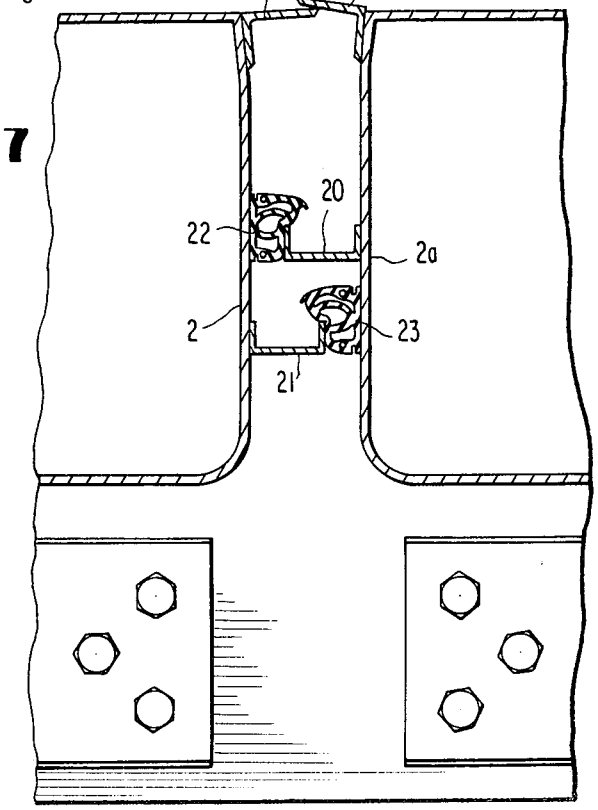
FIG. 7 is a side view of the weather seal in two individual sections of the barge cover of this invention.
Figure 6:
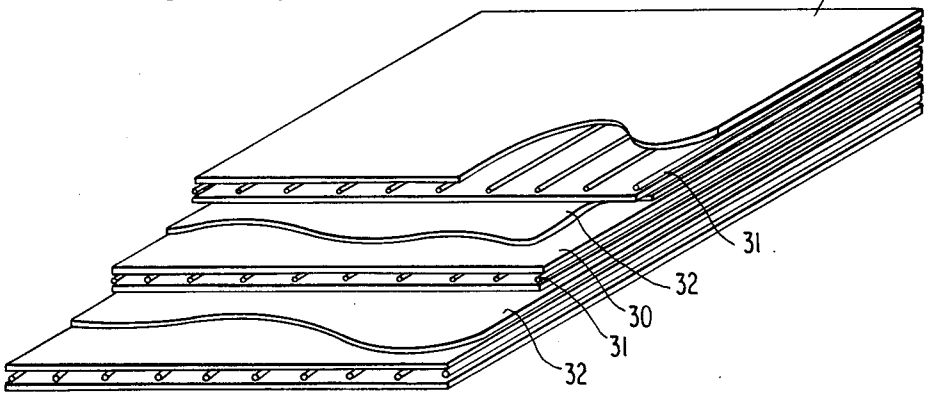
FIG. 6 is a diagrammatical view of the typical lamination employed in the construction of this invention.
Figure 8:
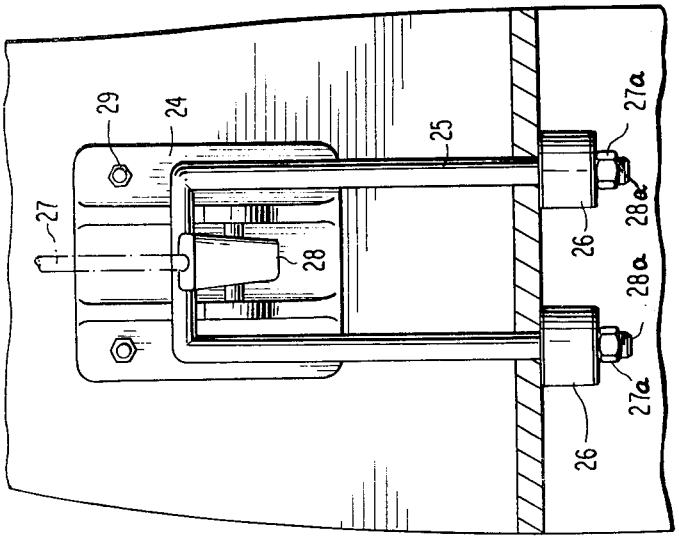
FIG. 8 is a plane view of an exemplary means for attaching the individual cover sections of this invention to the barge on which they rest.

As noted above, except where employing gaskets or sealing members such as depicted in FIGS. 7 and 8, or rebar, such as depicted in FIG. 3, all the materials employed in the construction of this invention are preferably made of lightweight structural fabrics. In a further preferred embodiment, that structural fabric is a fiberglass laminate, as is illustrated in FIG. 6. This preferred laminate is comprised of a first layer of woven fiberglass 30, of a type familiar to one of skill in the art. Underlying this layer is a layer of uniglass 31, and further underlying that layer is a layer of fiberglass chop filler 32. This series of layers can be repeated a number of times, until a sufficient strength is provided, but before the structural material becomes so heavy as to deprive the barge cover of the advantages and the objects described hereinabove. The layers can be secured, one to each other, by any of a number of methods commonly practiced in the art, including, but not limited to, application of adhesives between layers or resin encapsulation.

As is shown in FIG. 9, in the practice of this invention, a barge 33 supports a plurality of cover sections 34, as disclosed above. These cover sections, abutting and adjoining each other with weather seal means as described above or equivalent means, extend the entire length of the hatch opening of the barge, thereby providing a lightweight and watertight cover of surprising strength, which reduces the weight of the barge, increases carrying capacity, and reduces cost per ton of load.

Although the barge cover of this invention has been described with particularity, it will be understood that the description provided is for illustration, and that the invention as claimed below contemplates all equivalents within the practice of this barge cover. Specifically, the nature, type and quality of the materials employed in constructing the cover will vary according to the understanding of one of ordinary skill in the art. Further, the emplacement of, and number of reinforcement rebars and fiberglass pipes may vary according to the particular needs of those of skill practicing the invention.

What is claimed is:

1. A cover for oceangoing barges, said barges defining an upwardly open space, said cover comprising a set of adjacent, generally coplanar individual cover units, each said cover unit being further comprised of:

a cover member extending across the width of the opening in said barge, said cover unit being, in cross-section, of a shape resembling a series of joined, concave, caternary curves, longitudinal and lateral end panels extending integrally downward from said cover member, said longitudinal and lateral end panels engaging the deck of the barge on which they rest, a plurality of laterally spaced structural beams affixed to the underside of said cover member, extending perpendicular to the longitudinal centerline of said barge and between said longitudinal end panels, a plurality of support pipes extending through said support beams and substantially parallel to the longitudinal center of said barge, a weather-seal means affixed to each longitudinal end panel of said unit, for articulation with the corresponding weather-seal means of adjacent units, so as to provide a watertight seal between said units along said longitudinal end panels, said cover being of sufficient strength and deflection characteristics so as to be suitable for extended use on ocean seas.

2. The barge cover of claim 1, wherein said cover members, panel, structural beams and support pipes are substantially comprised of a light-weight structural fabric.

3. The barge cover of claim 2, wherein said structural beams have a base and walls defining an upwardly open shape and encase rebar supports in the walls and base thereof.

4. The barge cover of claim 3, wherein the point of attachment of said structural beams with said cover member is reinforced with a thickened layer of uniglass.

5. The barge cover of claim 2, wherein the point of attachment of said structural beams with said cover member is reinforced with a thickened layer of uniglass.

6. The barge cover of claim 2, wherein said fabric is comprised principally of fiberglass.

7. The barge cover of claim 6, wherein said structural beams have a base and walls defining an upwardly open shape and encase rebar supports in the walls and base thereof.

8. The barge cover of claim 7, wherein the point of attachment of said structural beams with said cover member is reinforced with a thickened layer of uniglass.

9. The barge cover of claim 6, wherein the point of attachment of said structural beams with said cover member is reinforced with a thickened layer of uniglass.

10. The barge cover of claim 6, wherein the fiberglass is present principally as a laminate of various layers of structural fiberglass material.

11. The barge cover of claim 10, wherein said structural beams have a base and walls defining an upwardly open shape and encase rebar supports in the walls and base thereof.

12. The barge cover of claim 11, wherein the point of attachment of said structural beams with said cover member is reinforced with a thickened layer of uniglass.

13. The barge cover of claim 10, wherein the point of attachment of said structural beams with said cover member is reinforced with a thickened layer of uniglass.

14. The barge cover of claim 10, wherein said laminate is comprised of alternating, repeating layers of woven fiberglass, uniglass and fiberglass chopped filler.

15. The barge cover of claim 14, wherein said structural beams have a base and walls defining an upwardly open shape and encase rebar supports in the walls and base thereof.

16. The barge cover of claim 15, wherein the point of attachment of said structural beams with said cover member is reinforced with a thickened layer of uniglass.

17. The barge cover of claim 14, wherein the point of attachment of said structural beams with said cover member is reinforced with a thickened layer of uniglass.

18. The barge cover of claim 1, wherein said structural beams have a base and walls defining an upwardly open shape and encase rebar supports in the walls and base thereof.

19. The barge cover of claim 18, wherein the point of attachment of said structural beams with said cover member is reinforced with a thickened layer of uniglass.

20. The barge cover of claim 1, wherein the point of attachment of said structural beams with said cover member is reinforced with a thickened layer of uniglass.

21. The barge cover of claim 1, wherein each said cover member is provided with at least one hatch and openable hatch cover through which cargo can be loaded into said barge.

* * * * *